US006012651A

United States Patent [19]

Spitznagel

[11] Patent Number: 6,012,651

[45] Date of Patent: Jan. 11, 2000

[54] GRAVITY-FED SPRAY GUN ASSEMBLY

[76] Inventor: Max W. A. Spitznagel, 13207 Warren Ave., Los Angeles, Calif. 90066

[21] Appl. No.: 09/058,708

[22] Filed: Apr. 10, 1998

[51] Int. Cl.[7] ..... B05B 7/30

[52] U.S. Cl. ..... 239/345; 239/377; 239/379; 285/190

[58] Field of Search ..... 239/345, 377, 239/379, 346, 318; 285/190

[56] References Cited

U.S. PATENT DOCUMENTS

| | | | |
|---|---|---|---|
| 1,748,440 | 2/1930 | Burdick | 239/345 |
| 2,887,274 | 5/1959 | Swenson | 239/371 |
| 2,961,335 | 11/1960 | Shepard | 117/46 |
| 3,236,459 | 2/1966 | McRitchie | 239/416 |
| 4,775,174 | 10/1988 | Dalla Bona et al. | 285/190 |
| 4,955,643 | 9/1990 | Bona et al. | 285/190 |
| 4,978,072 | 12/1990 | Kurowski | 239/346 |
| 5,069,389 | 12/1991 | Bitsakos | 239/345 |
| 5,366,158 | 11/1994 | Robisch et al. | 239/345 |
| 5,372,389 | 12/1994 | Tam et al. | 285/94 |
| 5,415,351 | 5/1995 | Otto et al. | 239/345 |
| 5,454,517 | 10/1995 | Naemura | 239/417.3 |
| 5,582,350 | 12/1996 | Kosmyna et al. | 239/345 |
| 5,803,360 | 9/1998 | Spitznagel | 239/345 |
| 5,810,258 | 9/1998 | Wu | 239/346 |
| 5,875,971 | 3/1999 | Morck | 239/346 |

FOREIGN PATENT DOCUMENTS

| | | | |
|---|---|---|---|
| 1512675 A1 | 10/1989 | U.S.S.R. | 239/145 |
| 139833 | 3/1920 | United Kingdom | 8695 18 |

*Primary Examiner*—Andres Kashnikow
*Assistant Examiner*—Dinh Q. Nguyen

[57] ABSTRACT

A gravity-fed spray gun assembly of the type having a nozzle assembly, a spray gun body assembly and a nozzle nut for adjusting the relative angular orientation of the nozzle assembly relative to the spray gun body assembly. The spray gun assembly includes a spray gun body assembly, a-fluid delivery assembly and a locking element. The fluid delivery assembly includes a rotatable element, a nozzle assembly and a fluid cup. The rotatable element is rotatably connected to the spray gun body assembly. The nozzle assembly is securely attached to the rotatable element. The nozzle assembly is maintained unable to rotate relative to the rotatable element unless a nozzle nut is adjusted. The nozzle assembly has a nozzle opening defining a nozzle axis. The rotatable element is rotatable about the nozzle axis. The fluid cup is securely attached to the rotatable element. A locking element cooperatively engages the spray gun body assembly and the fluid delivery assembly to securely lock the spray gun body assembly relative to the fluid delivery assembly at the desired relative angular orientation. The present invention obviates any requirement for loosening the nozzle nut to rotate the nozzle assembly relative to the spray gun body assembly when the fluid cup is rotated relative to the spray gun body assembly.

7 Claims, 4 Drawing Sheets

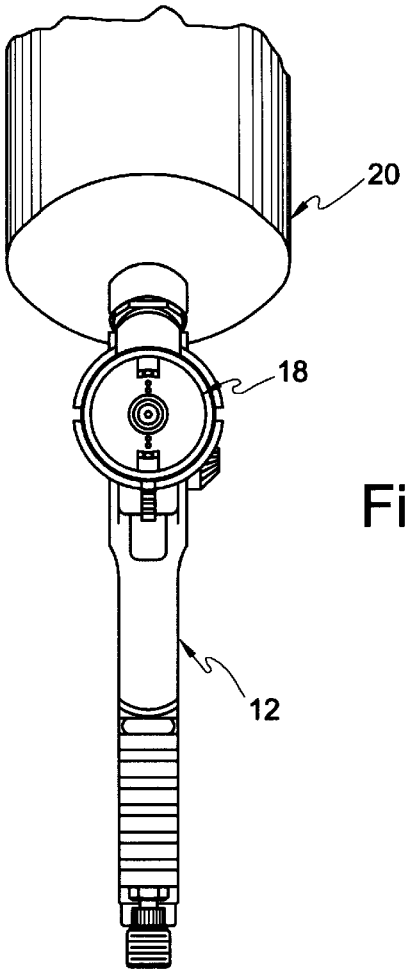
Fig. 5
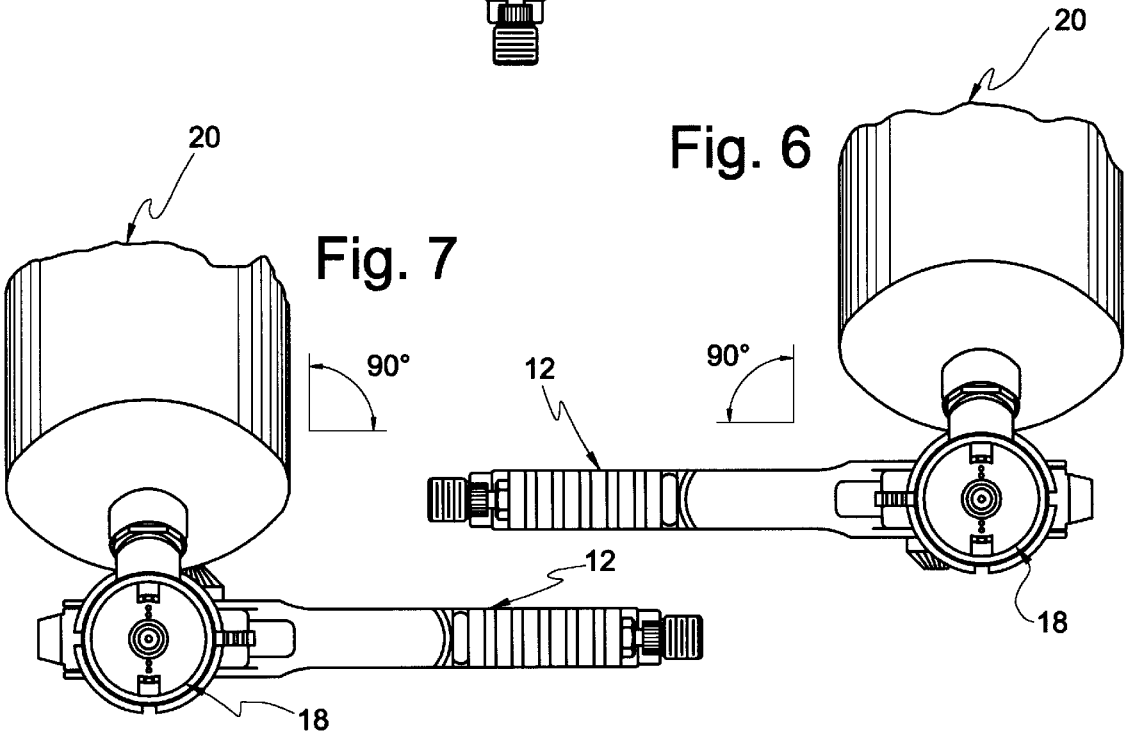
Fig. 6
Fig. 7

GRAVITY-FED SPRAY GUN ASSEMBLY

BACKGROUND OF THE INVENTION

1. Field of the Invention

The present invention relates to gravity-fed spray guns and more particularly to an apparatus for providing enhanced spray capabilities for such gravity-fed spray guns.

2. Description of the Related Art

Spray guns are commonly used to apply paint, primer or any other liquid substance to a surface. The most common handicap a painter encounters, regardless of whether he is using a gravity or suction spray gun is the inability to go low enough to paint upward. For example, in the auto body industry, the rocker panel (below the door line) is seldom painted on the lower surfaces. The reason for this deficiency is that the car is too low to the ground and the spray gun assembly is too long to provide for proper access. A gravity-fed spray gun, excluding regulator and hose connection is generally 11 to 13 inches long. A suction spray gun is generally 13 inches long excluding regulator and hose connection. The spray gun cannot be tilted sideways without the possibility of spilling paint from the cup or having the smooth flow of paint to the gun being interrupted.

Similar problems exist in the paint industry, generally. For example, in spraying overhead, the painter cannot always conveniently tilt the spray at the proper angle for proper application of the paint, or other surface treatments.

As one solution to these problems, the present applicant has invented an improved spray gun, disclosed and claimed in U.S. Pat. No. 5,803,360 entitled "Apparatus for Providing Enhanced Spray Gun Capabilities for a Gravity-Fed Spray Gun." That invention utilizes a swivel joint assembly that provides rotation of the fluid cup along a fluid cup offset axis, which is perpendicular to the fluid cup axis. After rotation of the fluid cup relative to the spray gun body the noble has to be rotated to obtain the previous spray pattern.

OBJECTS AND SUMMARY OF THE INVENTION

It is therefore a principal object of the present invention to provide efficient use of a gravity-fed spray gun for surfaces not easily accessible, such as low surfaces and overhead surfaces.

It is another object to obviate the requirement of rotating the nozzle assembly when the spray gun body is rotated relative to the fluid cup and still maintain the desired spray pattern orientation while maintaining the fluid cup in a substantially vertical position.

These and other objects are achieved by the present invention which is a gravity-fed spray gun assembly of the type having a nozzle assembly, a spray gun body assembly and a nozzle nut for adjusting the relative angular orientation of the nozzle assembly relative to the spray gun body assembly. The spray gun assembly includes a spray gun body assembly, a fluid delivery assembly and a locking element. The fluid delivery assembly includes a rotatable element, a nozzle assembly and a fluid cup. The rotatable element is rotatably connected to the spray gun body assembly. The nozzle assembly is securely attached to the rotatable element. The nozzle assembly is maintained unable to rotate relative to the rotatable element unless a nozzle nut is adjusted. The nozzle assembly has a nozzle opening defining a nozzle axis. The rotatable element is rotatable about the nozzle axis. The fluid cup is securely attached to the rotatable element. A locking element cooperatively engages the spray gun body assembly and the fluid delivery assembly to securely lock the spray gun body assembly relative to the fluid delivery assembly at the desired relative angular orientation. The present invention obviates any requirement for loosening the nozzle nut to rotate the nozzle assembly relative to the spray gun body assembly when the spray gun body assembly is rotated relative to the fluid cup.

Other objects, advantages, and novel features will become apparent from the following detailed description of the invention when considered in conjunction with the accompanying drawings.

BRIEF DESCRIPTION OF THE DRAWINGS

FIG. 5 is a front view of the spray gun assembly of the present invention.

FIG. 6 is another front view showing the spray gun body assembly rotated clockwise ninety degrees, with the fluid cup and nozzle assembly remaining in the same position.

FIG. 7 is another front view showing the gun body rotated counter-clockwise ninety degrees with the fluid cup and nozzle assembly remaining in the same position.

The same reference characters designate the same parts or elements throughout the drawings.

DETAILED DESCRIPTION OF THE PREFERRED EMBODIMENTS

Figure 1:
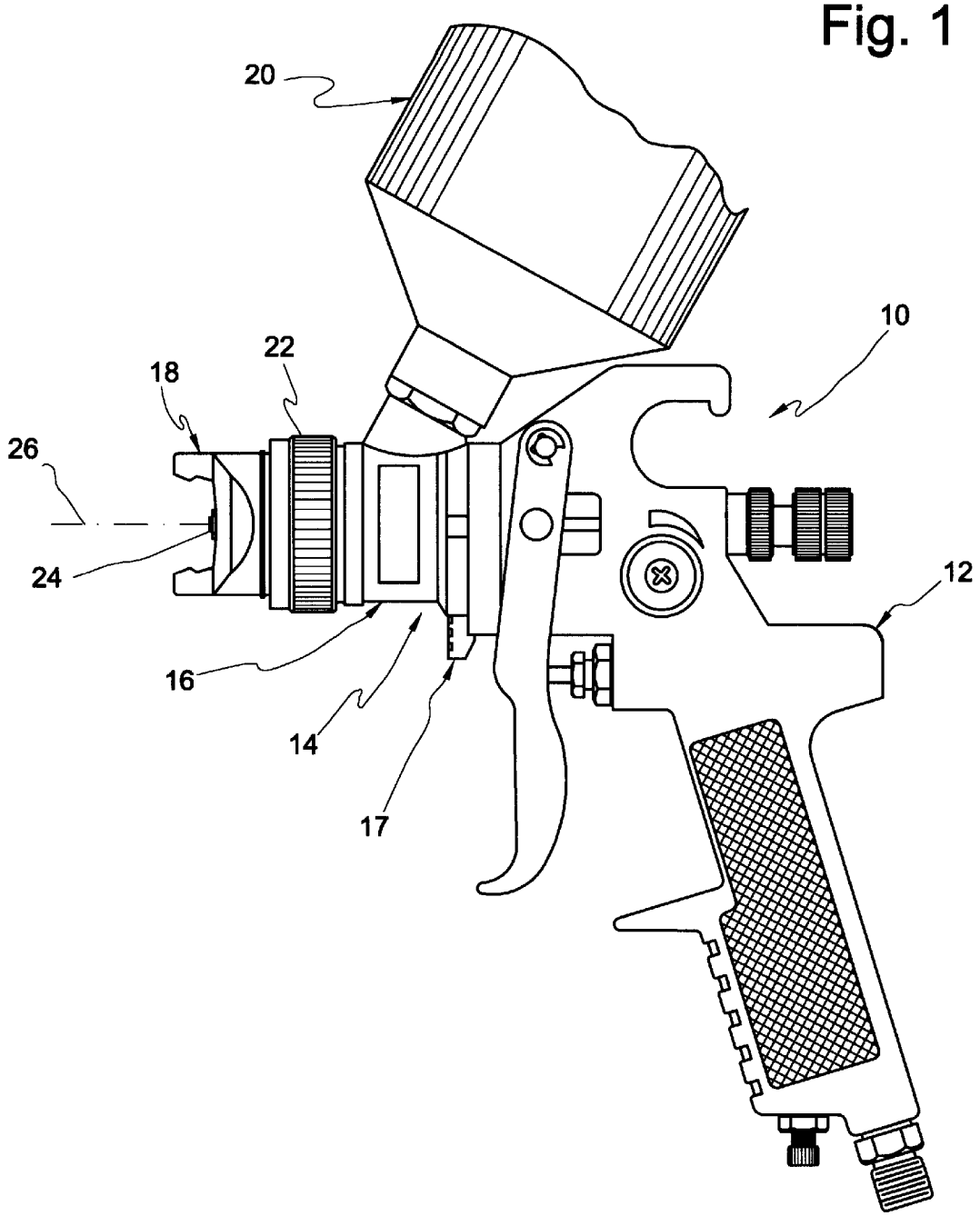
FIG. 1 is a side perspective view of the gravity-fed spray gun assembly of the present invention.
Figure 2:
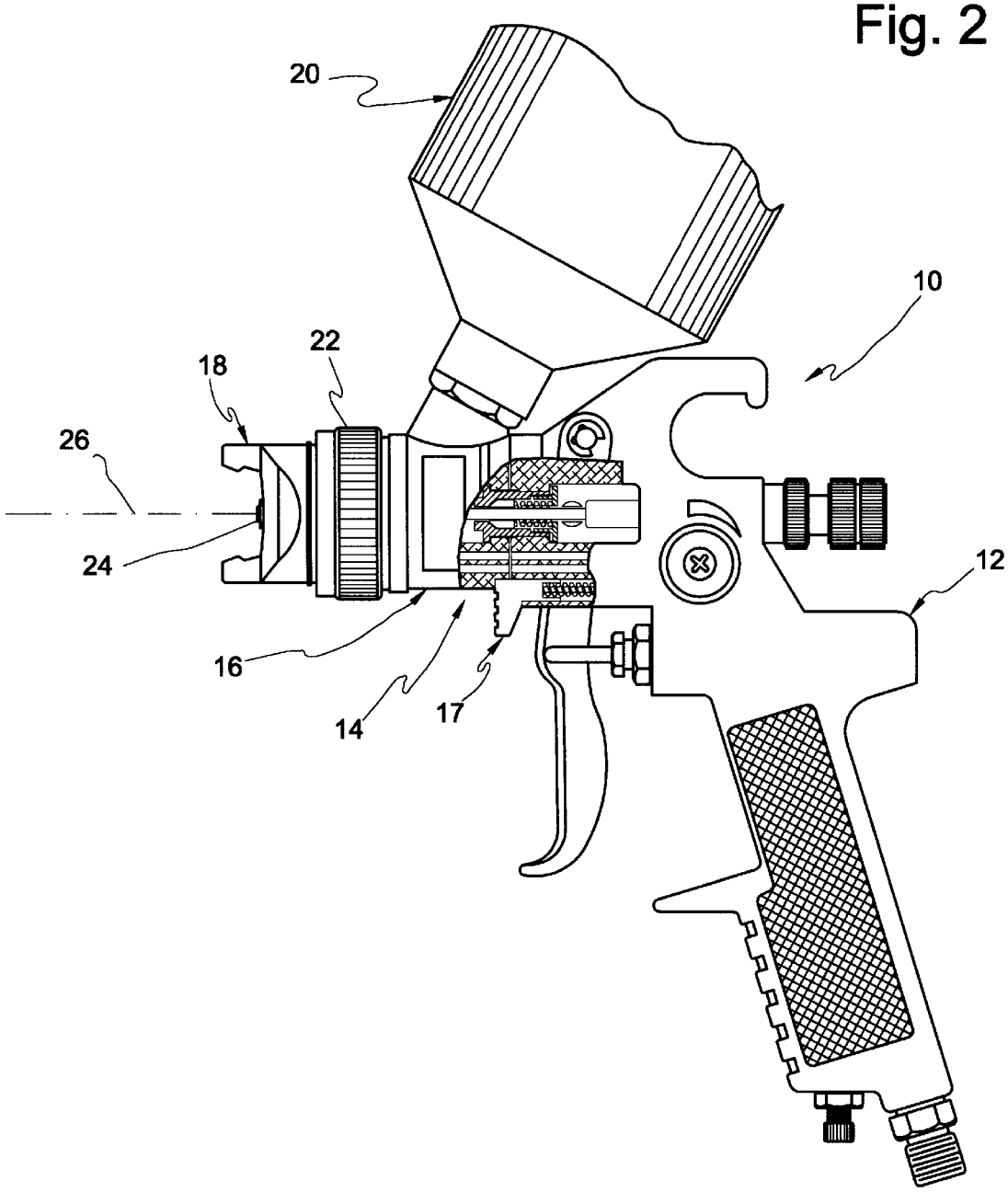
FIG. 2 is a side perspective view having a cut-away portion to reveal internal parts thereof.

Referring now to the drawings and the characters of reference marked thereon, FIG. 1 and 2 illustrate a preferred embodiment of the present invention, designated generally as 10. The gravity fed spray gun assembly includes a spray gun body assembly 12, a fluid delivery assembly 14 and a locking element 17. The fluid delivery assembly 14 includes a rotatable element 16, a nozzle assembly 18 and a fluid cup 20. The rotatable element 16 is rotatively connected to the spray gun body assembly 12, as will be explained in detail below. The nozzle assembly 18 is securely attached to the rotatable element 16 during use. The nozzle assembly 18 is unable to rotate relative to the rotatable element 16 unless the nozzle nut 22 is adjusted. The nozzle assembly 18 has a nozzle opening 24 defining a nozzle axis 26. The rotatable element 16 is rotatable about the nozzle axis 26. The fluid cup 20 is secured to the rotatable element 16. Fluid cup 20 is screwed into position and is therefore unable to rotate relative to the rotatable element during use.

Figure 3:
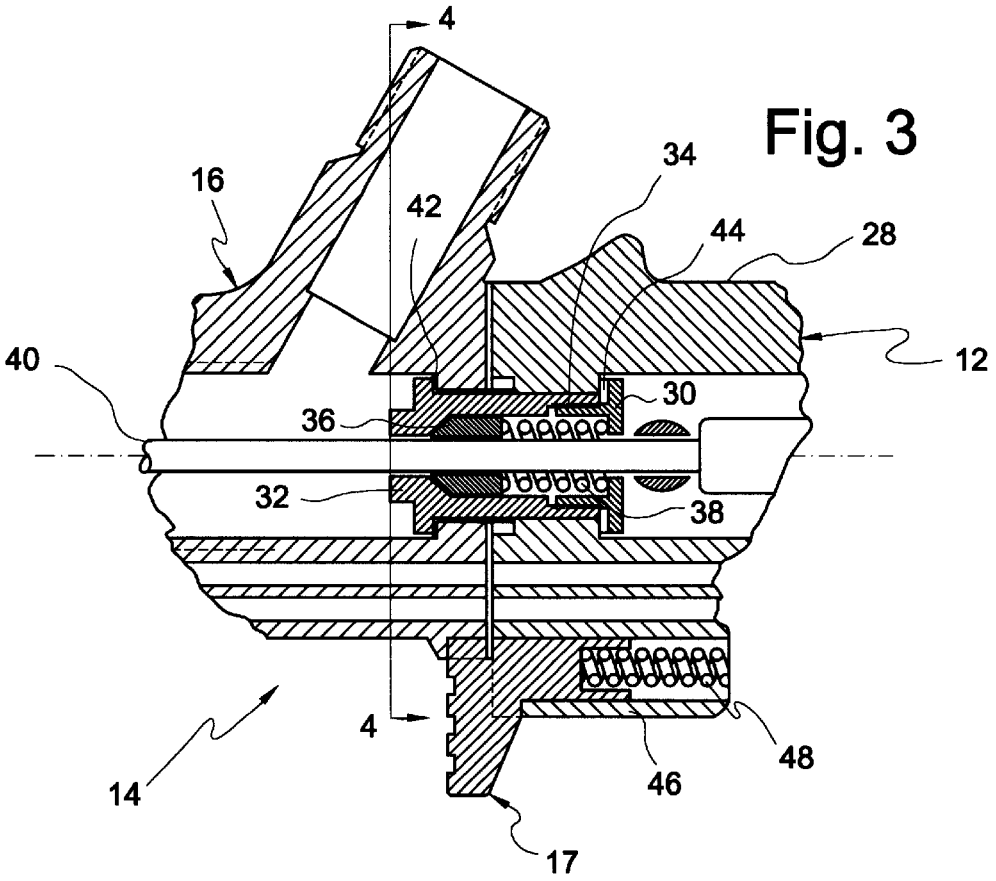
FIG. 3 is an enlarged view, partially cut-away, of a portion of the present invention.

Referring now to FIG. 3 an enlarged view of salient portions of the spray gun body assembly 12 and fluid delivery assembly 14 are illustrated. The spray gun body assembly 12 includes a spray gun body 28, which retains a hollow fastener 30 therewithin. The hollow fastener may comprise for example, a hollow nut. The rotatable element 16 retains a hollow bolt 32 therewithin. The hollow fastener 30 and the hollow bolt 32 are threadibly engaged, as shown at location 34. Inside this resulting assembly is positioned a Teflon™ needle seal 36. Also retained within this assembly is a biasing spring 38 for the seal 36. The seal 36 prevents fluid seepage adjacent to the needle 40. A bushing 42 is pressed into the rotatable element 16 to serve as a fixing guide. A spring washer 44 is provided to ensure a tight fit.

Figure 4:
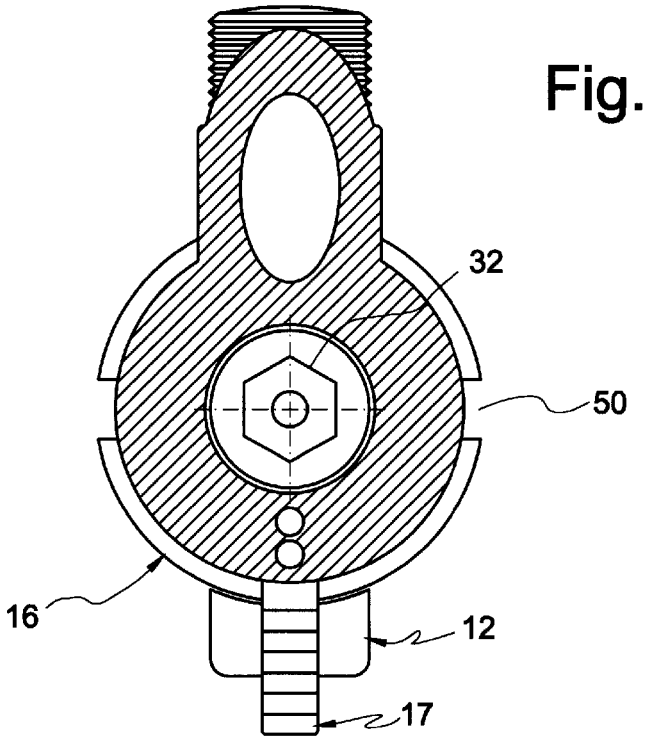
FIG. 4 is a view taken along line 4—4 of FIG. 3.

The locking element 17 is positioned within a slot 46 in the spray gun body assembly 12. A spring 48 pushes the locking element 17 into one of a plurality of circumferentially spaced indents 50 ( see FIG. 4). The indents 50 are formed within the rotatable element 16.

Referring now to FIGS. 5–7, the versatility of the present invention is illustrated. In FIG. 5, the fluid cup 20 and the spray gun body assembly 12 are both in vertical positions. The nozzle assembly 18 is positioned for the desired pattern.

Referring now to FIG. 6, the spray gun body assembly 12 is rotated to 90° clockwise. The fluid cup 20 remains vertical. However, the nozzle assembly 18 remains in the same position as that shown in FIG. 5. By being able to maintain the fluid cup 20 in a vertical position and concomitantly maintaining the nozzle assembly 18 in this desired position while being able to rotate the spray gun body assembly 12 to a comfortable desired angle, many painting and other spraying applications are realizable, which otherwise cannot be provided. For example, currently, painting of the rocker panels underneath the doors of the automobile, the wheel housings, wheel openings, trunks, engine base are all problematic because paint often drips out of the fluid cup or off of the fluid cup; or, the fluid cannot get to the nozzle assembly 18 because of the undesired orientation of the fluid cup 20. The present invention alleviates these problems, allowing the fluid cup 20 to remain in a vertical position. Furthermore, any requirement for loosening the nozzle nut 22 to rotate the nozzle assembly 18 relative to the spray gun body assembly 12, when the spray gun body assembly 12 is rotated relative to the fluid cup 20, is obviated.

FIG. 7 illustrates that the spray gun body assembly 12 can be rotated in the opposite direction but achieve the same desired effect.

Although the advantages of this invention have been described in particular with respect to the automobile industry it is understood that it can be utilized in many other industries, for example the furniture industry.

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. A gravity-fed spray gun assembly of the type having a nozzle assembly, a spray gun body assembly and a nozzle nut for adjusting the relative angular orientation of the nozzle assembly relative to the spray gun body assembly, comprising:

a) a spray gun body assembly;

b) a fluid delivery assembly, comprising:

i) a rotatable element rotatively connected to said spray gun body assembly;

ii) a nozzle assembly securely attached to said rotatable element, said nozzle assembly being unable to rotate relative to said rotatable element unless a nozzle nut is adjusted, said nozzle assembly having a nozzle opening defining a nozzle axis, said rotatable element being rotatable about said nozzle axis; and iii) a fluid cup securely attached to said rotatable element; and c) a locking element cooperatively engaging said spray gun body assembly and said fluid delivery assembly to securely lock said spray gun body assembly relative to said fluid delivery assembly at the desired relative angular orientation;

wherein any requirement for loosening the nozzle nut to rotate the nozzle assembly relative to the spray gun body assembly, when the spray gun body assembly is rotated relative to the fluid cup, is obviated.

2. The gravity-fed spray gun assembly of claim 1, wherein:

said rotatable element includes a plurality of circumferentially spaced indents for engaging said locking element.

3. The gravity-fed spray gun assembly of claim 2, further including a spring for biasing said locking element.

4. The gravity-fed spray gun assembly of claim 1, wherein:

said spray gun body assembly, comprises:

a spray gun body; and a hollow fastener positioned within said spray gun body; and said fluid delivery system, comprises:

a hollow bolt positioned within said rotatable element; said hollow fastener and said hollow bolt being threadibly engaged.

5. The gravity-fed spray gun assembly of claim 1, wherein said desired relative angular orientation of the spray gun body assembly relative to said fluid delivery assembly comprises positions of substantially ±90°.

6. A method for spraying fluid using a gravity-fed spray gun assembly, said gravity-fed spray gun assembly being of the type having a nozzle assembly, a spray gun body assembly and a nozzle nut for adjusting the relative angular orientation of the nozzle assembly relative to the spray gun body assembly, said gravity-fed spray gun assembly comprising:

a) a spray gun body assembly:

b) a fluid delivery assembly, comprising:

i) a rotatable element rotatively connected to said spray gun body assembly:

ii) a nozzle assembly securely attached to said rotatable element, said nozzle assembly being unable to rotate relative to said rotatable element unless a nozzle nut is adjusted, said nozzle assembly having a nozzle opening defining a nozzle axis, said rotatable element being rotatable about said nozzle axis; and iii) a fluid cup securely attached to said rotatable element: and c) a locking element cooperatively engaging said spray gun body assembly and said fluid delivery assembly to securely lock said spray gun body assembly relative to said fluid delivery assembly at the desired relative angular orientation, the method for spraying fluid, comprising:

a) maintaining said spray gun body assembly in a substantially vertical position: and b) rotating said spray gun body assembly to a desired position while concomitantly maintaining the fluid cup in a substantially vertical position, wherein any requirement for loosening the nozzle nut to rotate the nozzle assembly relative to the spray gun body assembly, when the spray gun body assembly is rotated relative to the fluid cup, is obviated.

7. The method of claim 6, wherein said step of rotating said spray gun body assembly comprises rotating the spray gun body assembly substantially 90° from the vertical position.

* * * * *